United States Patent [19]

Holyoke

[11] Patent Number: 5,046,286

[45] **Date of Patent: * Sep. 10, 1991**

[54] APPARATUS AND METHOD FOR REMOVING PHOTOGRAPHIC IMAGES FROM A FLEXIBLE FILM MEMBER

[76] Inventor: Robert H. Holyoke, 4001 N. Ocean Blvd., Apt. 301B, Boca Raton, Fla. 33431

[ * ] Notice: The portion of the term of this patent subsequent to Jul. 17, 2007 has been disclaimed.

[21] Appl. No.: 511,305

[22] Filed: Apr. 19, 1990

[51] Int. Cl.[5] ..... B24B 21/00

[52] U.S. Cl. ..... 51/137; 51/74 R; 51/78; 51/326

[58] Field of Search ..... 51/74 R, 78, 137, 138, 51/139, 326

[56] References Cited

U.S. PATENT DOCUMENTS

| | | | |
|---|---|---|---|
| 1,022,827 | 4/1912 | Cox | 51/139 |
| 2,424,044 | 7/1947 | Miller | 51/139 |
| 3,153,306 | 10/1964 | Robischung | 51/135 |
| 3,277,609 | 10/1966 | Horie et al. | 51/78 |
| 3,683,559 | 8/1972 | Kalwaites | 51/74 |
| 4,201,015 | 5/1980 | Reim | 51/74 |

*Primary Examiner*—M. Rachuba

*Attorney, Agent, or Firm*—Oltman and Flynn

[57] ABSTRACT

This apparatus and method for removing photographic images from a flexible Mylar film member is based on scraping laterally spaced areas of the film member passing between respective power-driven film-advance rollers and spring-biased pressure rollers. The film member is scraped by power-driven, endless, flexible, abrasive belts passing next to the film-advance and pressure rollers but out of contact with them. Each abrasive belt is tensioned to follow part of the peripheral contour of a belt-deflection roller located next to a film-advance roller. The speed of the abrasive belts is many times greater than the surface speed of the film-advance rollers. Two laterally offset sets of film-advance rollers and abrasive belts engage the film member at different locations along its path of movement, and the last set of abrasive belts scrape segments of the film member that were not scraped by the first set of belts.

23 Claims, 7 Drawing Sheets

APPARATUS AND METHOD FOR REMOVING PHOTOGRAPHIC IMAGES FROM A FLEXIBLE FILM MEMBER

This invention relates to an apparatus and method for removing photographic images from a flexible photographic film member, such as a microfiche or a roll of film.

BACKGROUND OF THE INVENTION

Mylar film, either in microfiche form or in a roll, often is used for photographically recording highly sensitive information. Mylar film is a highly oriented polyester. When the decision is made to destroy this recorded information it is necessary that the destruction be so complete as to eliminate the possibility that an unauthorized person might reconstruct a useful amount of the putatively destroyed information.

My copending U.S. patent application Ser. No. 07/299,796, filed Jan. 23, 1989, discloses an apparatus for scraping photographic images from a Mylar or other film member which comprises:

feed rollers and pressure rollers for advancing the film member along a predetermined straight-line path without slippage between the feed rollers and the film member;

a first abrading roller and pressure rollers for scraping off segments of the photographic images at certain locations across the width of the film member.

a second abrading roller nd pressure rollers for scraping off the remaining segments of the photographic images at their locations across the width of the film member;

and a motor drive arrangement for the feed rollers and the abrading rollers which rotates the abrading rollers at a much higher surface speed than the feed rollers, so that the surface speed of each abrading roller is much higher than the speed of the film member moving tangentially past it.

The pressure rollers that coact with the feed rollers are heavily spring-biased toward the feed rollers to prevent slippage of the film member, and the pressure rollers that coact with the abrading rollers are of relatively soft yieldable material and are lightly spring biased toward the abrading rollers. The scraping action of each abrading roller takes place on the film member at a different location along its path than the clamping action of each feed roller and the respective pressure roller so that any given longitudinal segment of the film member sequentially experiences clamping, abrading and clamping actions.

SUMMARY OF THE INVENTION

The present invention is directed to a novel apparatus ana method for scraping photographic images from a flexible film member, particularly a Mylar microfiche or film roll.

Another object of this invention is to provide such an apparatus in which all the photographic images are removed from the film member in a single transit of the film member through the apparatus.

Another object of this invention is to provide such an apparatus which has endless flexible abrasive belts, such as sanding belts, that are deflected to follow the peripheral contour of corresponding rollers over enough of the roller circumference to achieve a very effective and thorough scraping of photographic images from a flexible film member advancing between the belts ana the roller surfaces.

Another object of this invention is to provide a novel method of removing photographic images from a flexible film member in which a predetermined area of the film member is advanced and clamped between opposed rollers and simultaneously is scraped by an endless flexible abrasive belt, with both the film member and the abrasive belt being deflected to follow the peripheral contour of one of the rollers over a substantial part of that roller's peripheral extent.

Preferably, the present invention comprises first and second abrading stations through which a flexible film member is conveyed in succession, each abrading station having:

endless flexible abrasive belts, each passing from an idler roller to a belt-drive roller and deflected downward from a straight-line path between them by a corresponding belt-deflection roller above, which causes the respective belt to follow the peripheral contour of the bottom of the belt deflection roller over a circumferential extent of several degrees, preferably about 20 degrees;

power driven film-advance rollers coaxial with the belt-deflection rollers ana of substantially the same diameter as the belt deflection rollers and positioned outside the abrasive belts to engage the top of a film member inserted onto the belts between the idler and belt-deflection rollers;

spring-biased pressure rollers below the film advance rollers which hold the film member up against the film advance rollers;

and lower rollers which tension the belts so that they follow the peripheral contour of the belt-deflection rollers et the bottom.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
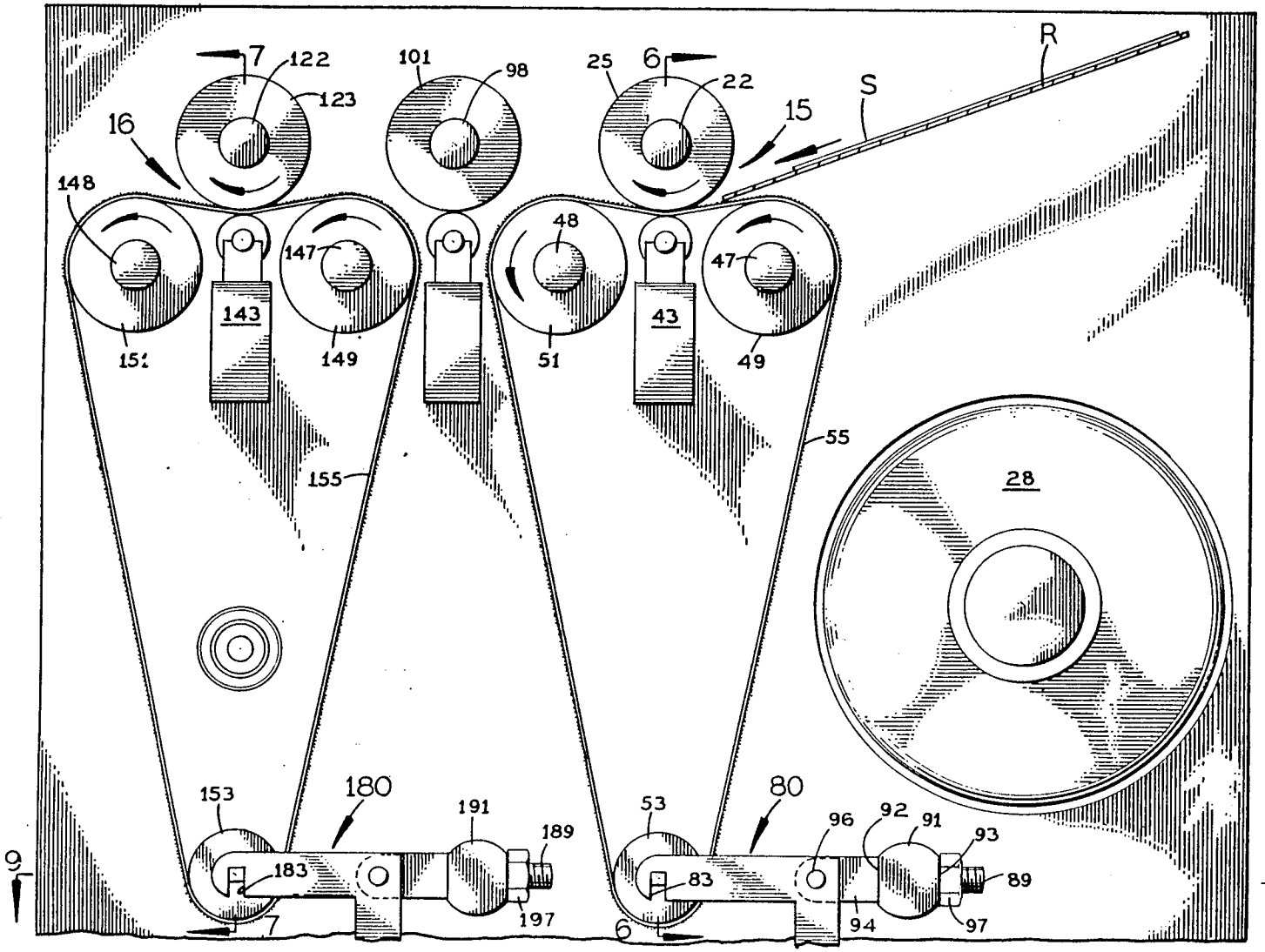
FIG. 1 is a side elevation of the working parts of the present apparatus.
Figure 12:
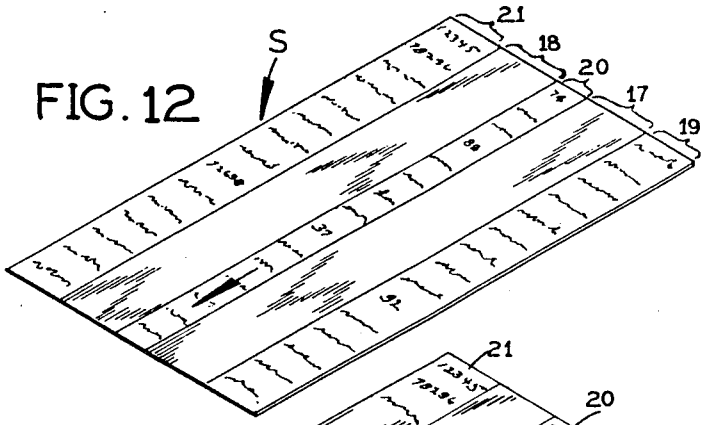
FIG. 12 is a top perspective view of the Mylar sheet after passing the first set of sanding belts to remove two parallel tracks of photographic images and before reaching the second set of sanding belts in the apparatus.
Figure 13:
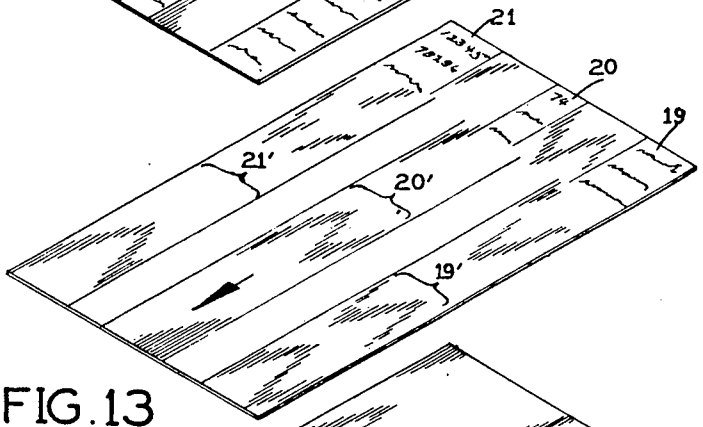
FIG. 13 is a similar view of the Mylar sheet showing schematically the removal of remaining tracks of photographic images along its length.
Figure 14:
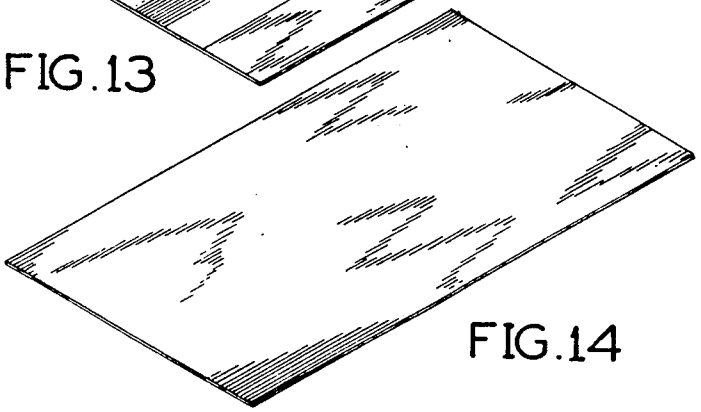
FIG. 14 is a similar view of the Mylar sheet after it has been scraped clean in the present apparatus.

Referring to FIG. 1, in broad outline the present apparatus has a first abrading station 15 and a second abrading station 16 through which a Mylar sheet with photographic images on it moves in succession (from right to left in FIG. 1). As shown ia FIG. 12, ia the first abrading station 15 two laterally spaced parallel tracks 17 and 18 of the photographic images ere removed from the Mylar sheet S, leaving three parallel tracks 19, 20 and 21 of the photographic images still on the film. As indicated in FIG. 13, in the second abrading station 16 the Mylar sheet S is scraped along three parallel tracks 19', 20' and 21' which include, and are slightly wider than, the tracks 19, 20 and 21. Tracks 19' and 20' partially overlap the track 17 along its opposite edges, and tracks 20' and 21' partially overlap the track 18 along its opposite edges. Coming out of the second abrading station 16, the Mylar sheet S has had all of the photographic images removed, as shown ia FIG. 14.

Figure 2:
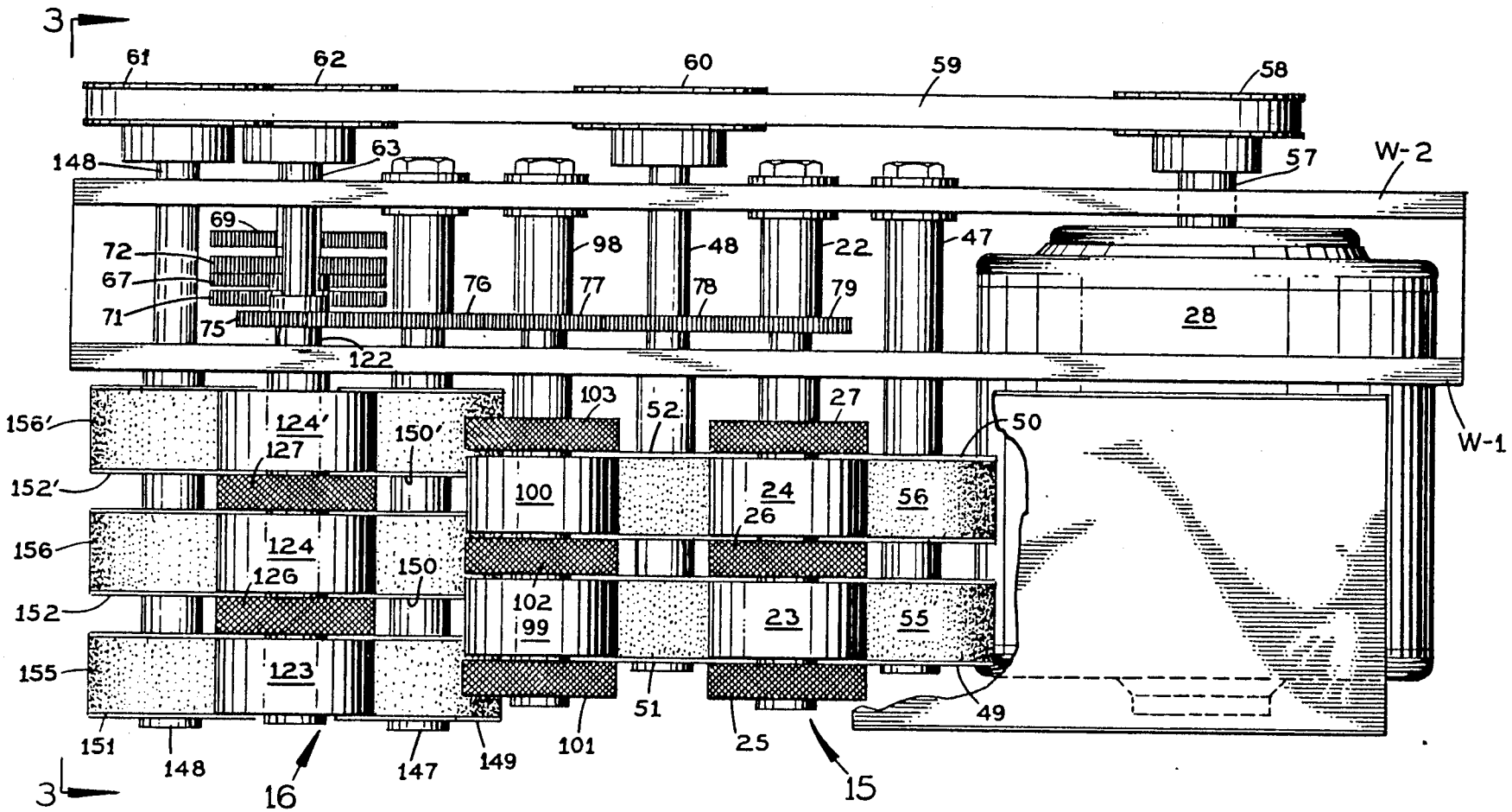
FIG. 2 is a top plan view of this apparatus.
Figure 6:
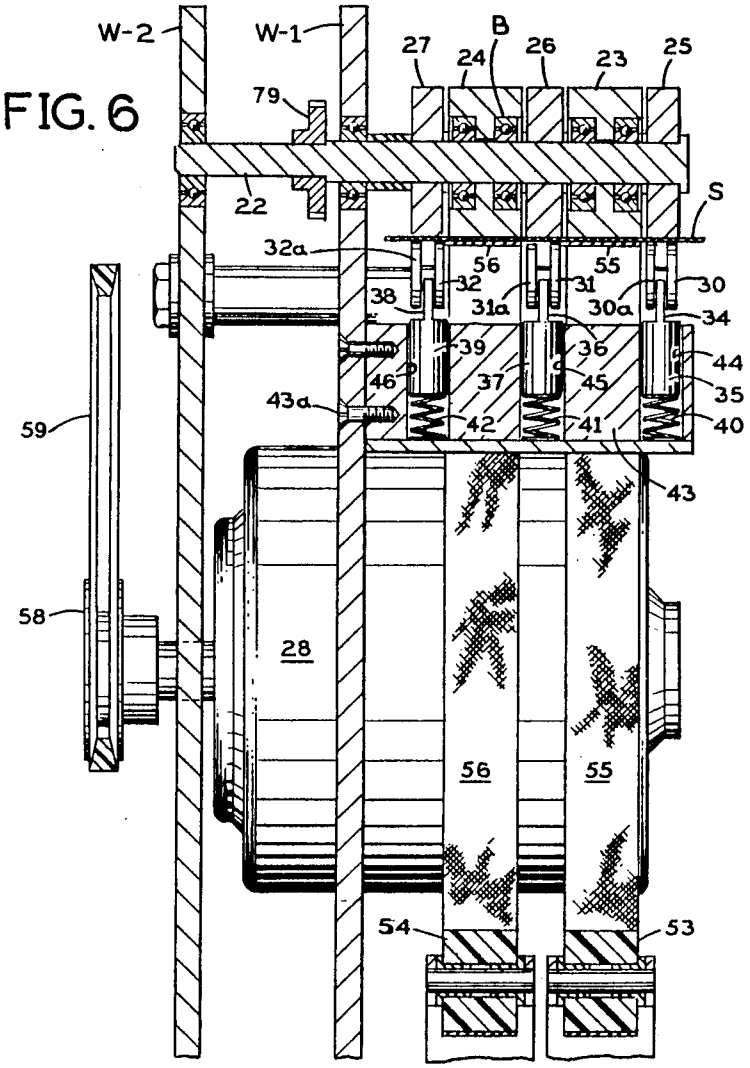
FIG. 6 is a vertical cross-section taken along the line 6—6 in FIG. 1 and showing the Mylar sheet engaged between a first set of rollers above and sanding belts and pressure rollers below.

Referring to FIGS. 1, 2 and 6, the first abrading station 15 of the apparatus has a horizontal upper drive shaft 22 which carries an upper roller assembly comprising a pair of relatively wide, smooth surfaced, cylindrical, upper, belt-deflection rollers 23 and 24 of rubber or rubber-like material and three narrower, knurled film-advance rollers 25, 26 and 27, all of the same diameter and coaxial with one another and all engageable with the Mylar sheet S from above. Each roller 23 and 24 is a belt-deflection means in the present apparatus, and each roller 25, 26 and 27 is a film advance means, as explained hereinafter. The knurled film-advance roller 26 is between the belt-deflection rollers 23 nd 24, the knurled film-advance roller 25 is on the opposite side of roller 23 from roller 26 and the other knurled film advance roller 27 is on the opposite side of roller 24 from roller 26.

Shaft 22 is driven from an electric motor 28, as explained hereinafter. The film-advance rollers 25, 26 and 27 are rigidly affixed to shaft 22 to rotate in unison with it. The belt-deflection rollers 23 and 24 are mounted on ball bearings B on shaft 22 so they do not rotate in unison with it.

As shown in FIG. 6, at its end remote from rollers 23–27 the drive shaft 22 is rotatably supported in ball bearings B in a vertical housing wall W 2. Also, shaft 22 is rotatably supported in bearings in an inner housing wall W-1 closer to the film-advance roller 27. Most of the length of shaft 22 is on the opposite side of wall W-1 from wall W-2, and this length of the shaft (carrying rollers 23–27) is cantilevered.

Vertically below the upper roller shaft 22, respective horizontal shafts carry three pairs of smooth surfaced, cylindrical pressure rollers 30 and **30*a*, 31 and 31*a*, and 32 and 32*a* (FIG. 6). These pressure rollers are of the same diameter as each other and of substantially smaller diameter than the upper rollers 23, 24, 25, 26 and 27. Each pair of rollers 30 and 30*a*, 31 and 31*a*, and 32 and 32*a* and the respective shaft may be a one-piece nylon body and they constitute a pressure means in this apparatus. Pressure rollers 30 and 30*a* are directly below the knurled film-advance roller 25. Pressure rollers 31 end 31*a* are directly below the knurled film advance roller 26. Pressure rollers 32 and 32*a* are directly below the knurled film-advance roller 27. None of the pressure rollers 30, 30*a*, 31, 31*a*, 32 or 32*a* is directly below either belt-deflection roller 23 or 24. The respective shafts for these paired rollers are rotatably supported from below by: a yoke 34 projecting up from a plunger 35 and slidably received between rollers 30 and 30*a*, a yoke 36 projecting up from a plunger 37 and slidably received between rollers 31 and 31*a*, and a yoke 38 projecting up from a plunger 39 and slidably received between rollers 32 and 32*a*. Plungers 35, 37 and 39 are vertically displaceable and are urged upward by respective springs 40, 41 and 42. A housing block 43 provides: a vertical cylinder 44 which slidably receives plunger 35 and its spring 40, a vertical cylinder 45 which slidably receives plunger 37 and its spring 41, and a vertical cylinder 46 which slidably receives plunger 39 and its spring 42. Housing block 43 is rigidly attached to housing wall W-1 by screws 43*a***.

The first abrading station 15 has: a horizontal first idler shaft 47 FIG. 1) on the entry side of the pressure rollers 30, **30*a*, 31, 31*a*, 32 and 32*a*, and a horizontal belt drive shaft 48 on the exit side of these pressure rollers. As shown in FIG. 2, idler rollers 49 and 50 on shaft 47 are aligned lengthwise of the apparatus with the belt-deflection rollers 23 and 24, respectively, on the entry side of the latter. Likewise, the belt drive shaft 48 carries belt drive rollers 51 and 52, which are aligned longitudinally of the apparatus with rollers 23 and 24, respectively, on the exit side of the latter. The idler rollers 49 and 50 and the belt drive rollers 51 and 52 have the same diameter as rollers 23 nd 24. As shown in FIG. 1, the top of the idler rollers 49 and 50 on the entry side is above the bottom of the periphery of the belt deflection rollers 23 and 24, and the top of the belt drive rollers 51 and 52 on the exit side is above the bottom of the periphery of the belt-deflection rollers 23 and 24**.

In the first abrading station 15, a first tensioning roller 53 (FIGS. 1 and 6) is spaced vertically below the belt-deflection roller 23 and a second tensioning roller 54 (FIG. 6) is located vertically below the belt-deflection roller 24. Each tensioning roller 53 and 54 is individually angularly adjustable as explained hereinafter.

In the first abrading station 15, a first flexible, endless, sanding belt 55 passes up around the first tensioning roller 53 to the idler roller 49 on the entry side, across the top of roller 49 and from right to left in FIG. 1 across the bottom of the belt-deflection roller 23, round the top of the belt drive roller 51 on the exit side, and back down to the tensioning roller 53. As shown in FIG. 6, belt 55 has a width between its opposite longitudinal edges which is less than the space between the knurled film-advance rollers 25 and 26 and it passes between the pressure rollers **30*a* and 31 without engaging either of them. Between rollers 49 and 51 this sanding belt is deflected downward in FIG. 1 as it passes under the belt-deflection roller 23 and it engages roller 23 over about 20 degrees circumferentially on the bottom. Only the tension in the belt holds it up against roller 23** over this bottom circumferential port of the roller.

An identical second flexible sanding belt 56 (FIG. 6) has the same path of travel up from the second tensioning roller 54 to the other upper idler roller 50 on the entry side, across the top of roller 50 and across the bottom of the belt-deflection roller 24, round the top of the corresponding belt drive roller 52 on the exit side, and down to the tensioning roller 54. As shown ia FIG. 6, belt 56 engages the belt deflection roller 24 across the full width of each but it does not engage either film-advance roller 26 or 27 or either pressure roller 31*a* or 32 on opposite sides of belt deflection roller 24.

As best seen in FIG. 1, the Mylar sheet S is fed down along an inclined ramp R into the first abrading station 15 on top of the sanding belts 55 and 56 as they leave the upper idler rollers 49 and 50 on the entry side. The bottom face of the Mylar sheet has photographic images that are to be destroyed and the outer face of the sanding belt is abrasive. The knurled film-advance rollers 25, 26 and 27 directly engage the top of Mylar sheet S and force it down against the paired pressure rollers 30 and 30*a*, 31 and 31*a*, and 32 and 32*a* below so that these upper nd lower rollers vance the Mylar sheet through the first abrading station from right to left in FIG. 1. The Mylar sheet passes beneath the belt deflection rollers 23 and 24 with its bottom face engaging the outer abrasive face of each sanding belt 55 and 56. The tension in these sanding belts holds them up against the Mylar sheet as it passes down under the upper rollers 23–27 and causes the belts to closely follow the peripheral contour of the respective belt deflection rollers 23 and 24 over about 20 degrees of their circumference on the bottom. Therefore, the abrading action of the sanding belts takes place over about 20 degrees of the circumference of the belt-deflection rollers 23 and 24.

In one practical embodiment, the speed of the Mylar sheet S (as determined by the rotational speed and diameter of the knurled film-advance rollers 25, 26 and 27) is about 15–20 feet per minute and the speed of the abrasive belts 55 and 56 is about 1000 feet per minute. Therefore, any given line across the longitudinal tracks 17 and 18 on the film sheet is scraped many times by the abrasive particles on the much faster moving abrasive belts. Also, this scraping or abrading action takes place on the film member over about 20 degrees circumferentially where it is being clamped by the action of pressure rollers 30, 30*a*, 31, 31*a*, 32 and 32*a* holding the Mylar film sheet up against the motor-driven film-advance rollers 25, 26 and 27.

Figure 4:
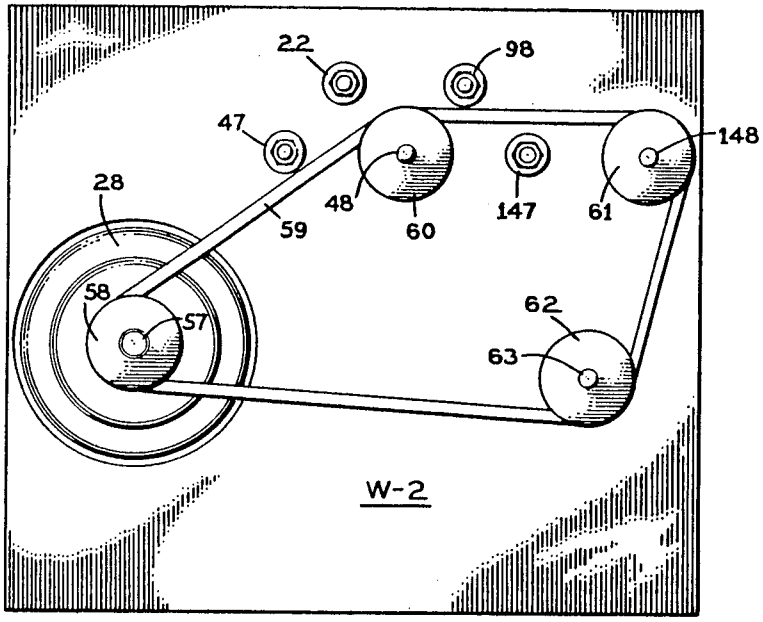
FIG. 4 is a side elevation taken from the line 4—4 in FIG. 3 and showing the drive motor, belt and pulleys in the drive mechanism of this apparatus.
Figure 5:
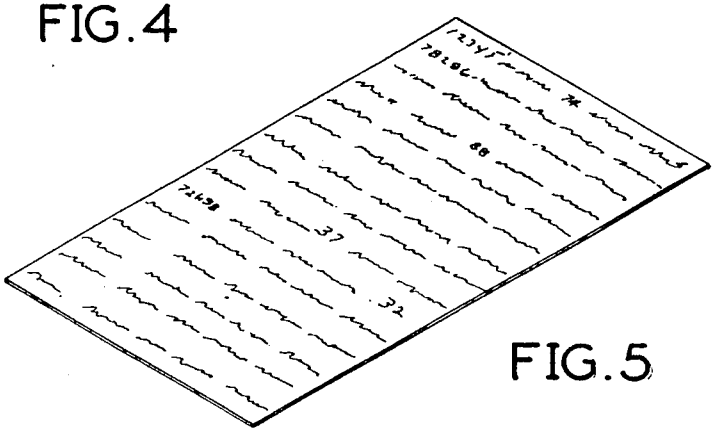
FIG. 5 is a top perspective view of a sheet of Mylar with photographic images shown schematically on one face which the present apparatus removes.
Figure 3:
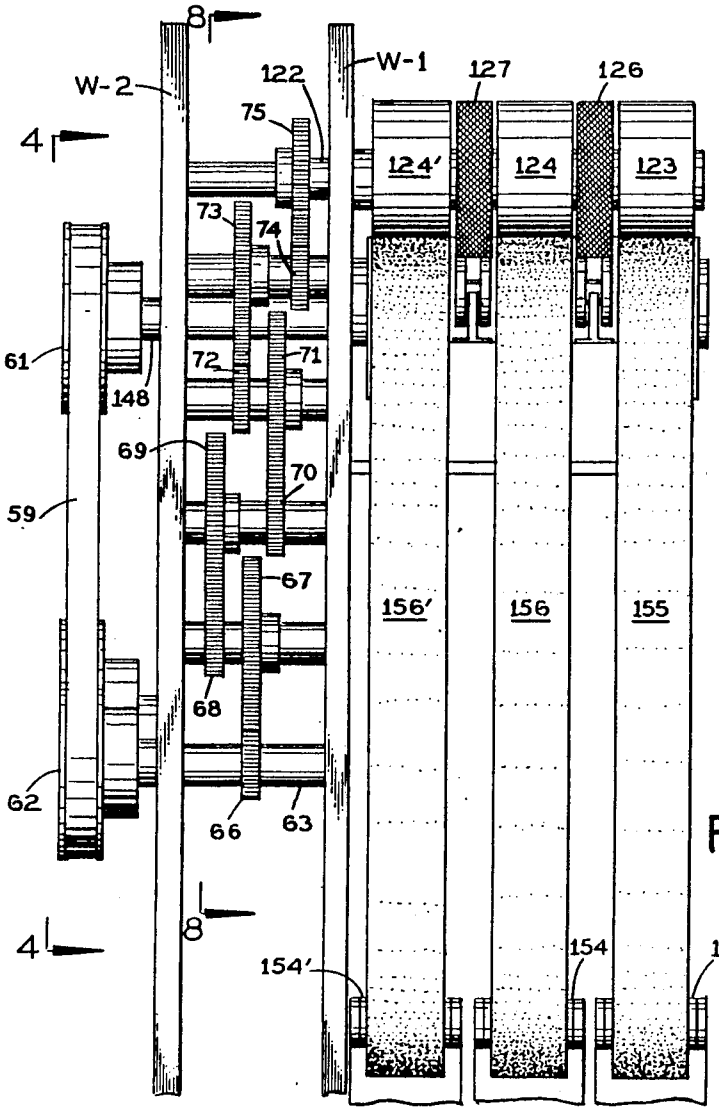
FIG. 3 is an end elevation taken form the left end of FIGS. 1 and 2.

As shown in FIGS. 2 and 6, drive motor 28 has an output shaft 57 carrying a pulley 58 which drives an endless flexible belt 59. As shown in FIG. 4, belt 59 drives three spaced pulleys 60, 61 and 62. Pulley 60 is on shaft 48 which carries the belt drive rollers 51 and 52 in the first abrading station 15. Pulley 61 is on a shaft 148 in the second abrading station 16. As shown in FIG. 3, pulley 62 is connected to a shaft 63 which carries a gear 66. Pulleys 58, 60, 61 and 62 are located outside the housing wall W-2, as shown in FIG. 2.

Figure 7:
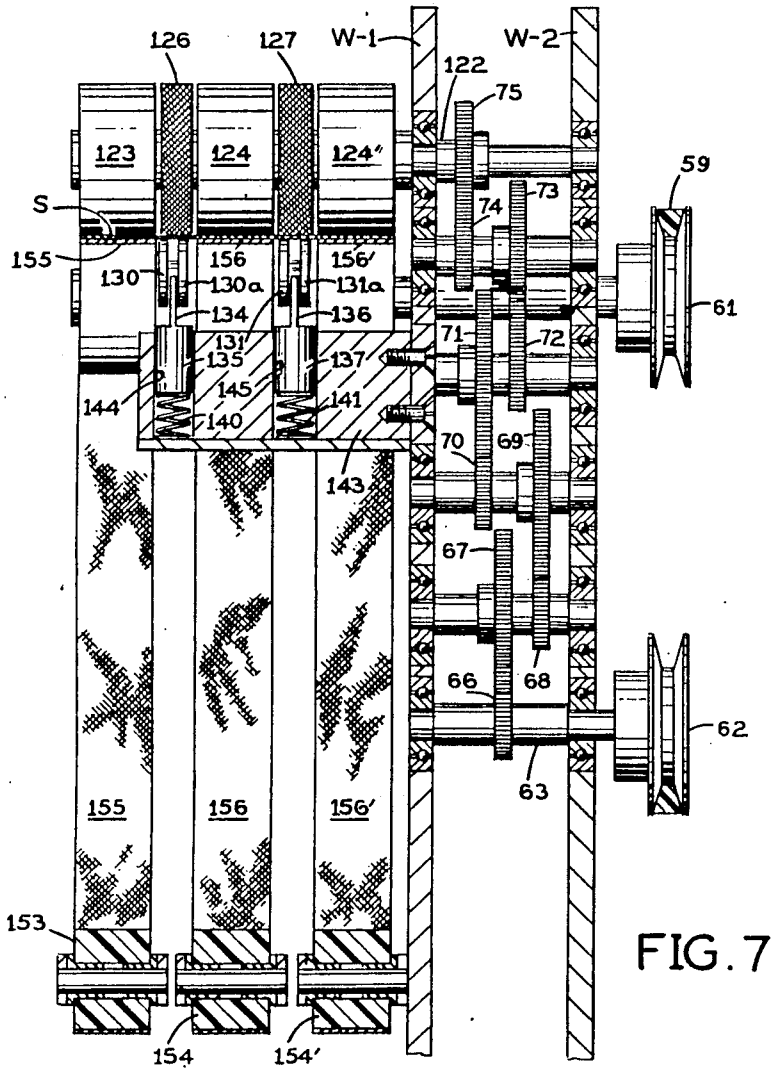
FIG. 7 is a vertical cross-section taken along the line 7—7 in FIG. 1 and showing the Mylar sheet engaged between a second set of rollers above and sanding belts and pressure rollers below, as well as the gear drive to the rollers.
Figure 8:
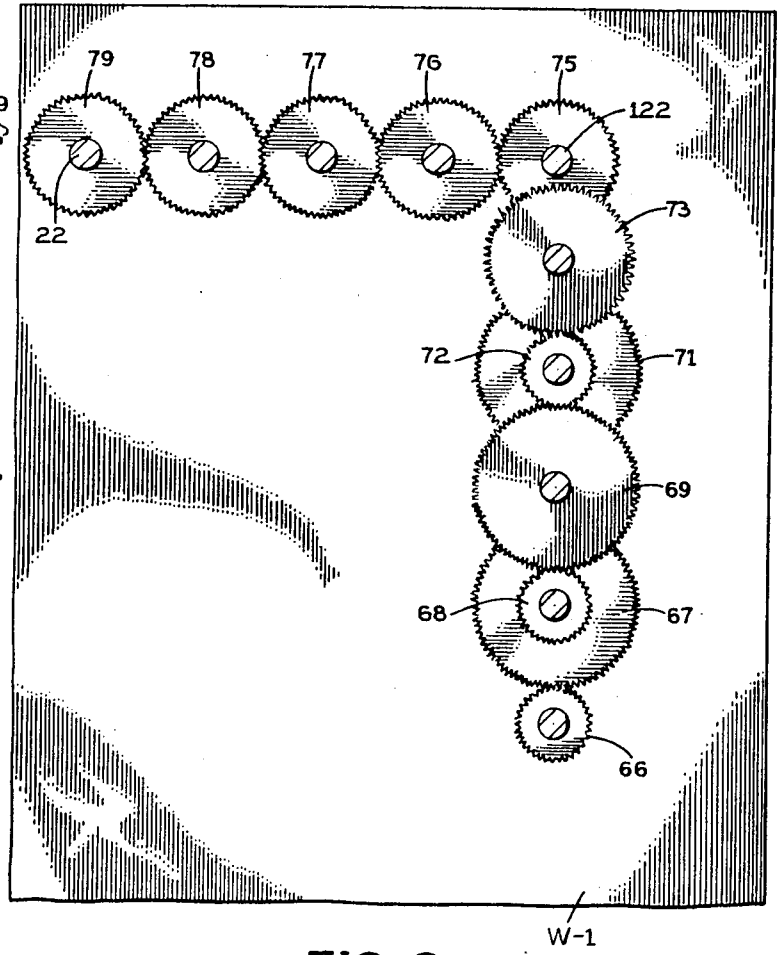
FIG. 8 is an end elevation of the gear drive taken from the vertical section line 8—8 in FIG. 3.

As shown in FIGS. 3, 7 and 8, the drive to the upper drive shaft 22 in the first abrading station 15 of the apparatus comes from gear 66 via speed-reducing gears 67, 68, 69, 70, 71, 72, 73, 74 and 75, and gears 76, 77, 78 and 79 (FIG. 8). These gears are located between the housing walls W-1 and W-2, as shown in FIG. 7. The shafts which carry gears 66–79 are rotatably supported by ball bearings B in housing walls W-1 and W-2.

Figure 9:
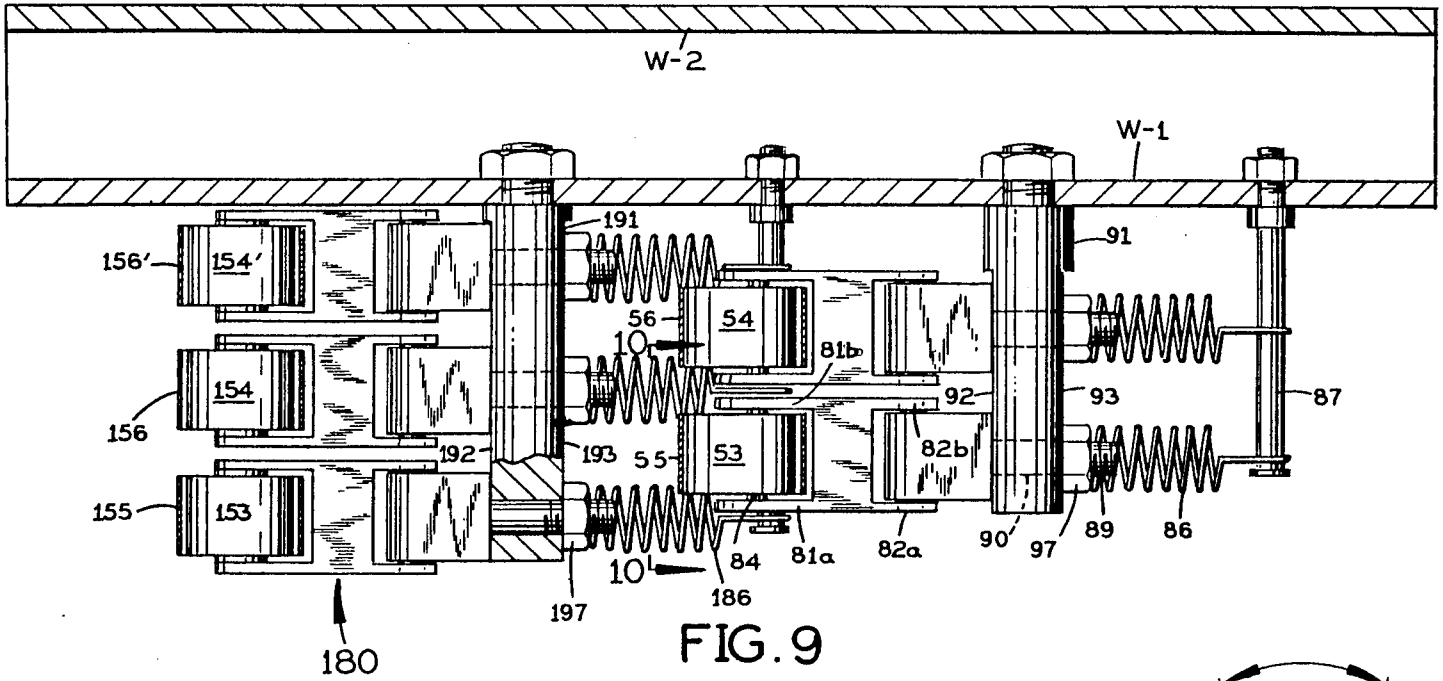
FIG. 9 is a horizontal longitudinal section taken along the line 9—9 in FIG. 1 and showing the belt tensioning and positioning mechanism in the present apparatus.
Figure 11:
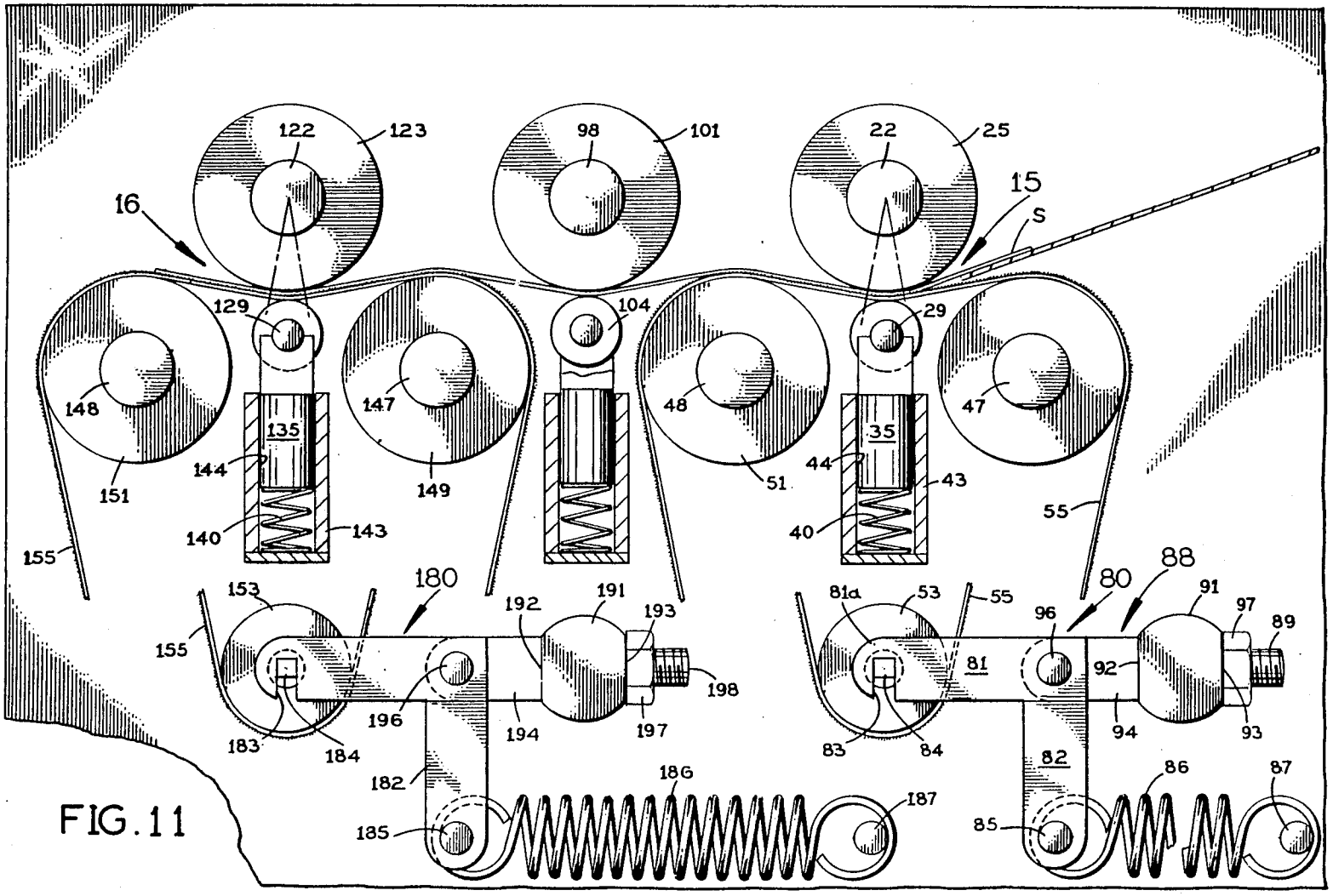
FIG. 11 is an enlarged elevation, with parts broke away, showing working parts of the present apparatus.

Referring to FIGS. 11 and 9, the vertical position of the tensioning roller 53 end thus the tension on sanding belt 55 is determined by a generally right-angled lever 80 (FIG. 11) having a generally horizontal upper leg 81 nd a generally vertical leg 82 extending down from it.

As shown ia FIG. 9, the upper leg 81 of the lever is bifurcated at its end away from its vertical leg 82, presenting laterally spaced free end segments 81*a* and 81*b*. As shown in FIG. 11, the free end segment 81*a* has a rectangular recess 83 which is open at the bottom. The other free end segment 81*b* has an identical recess (not shown) which is aligned with recess 83. A shaft 84 which carries roller 53 is received in the upper ends of these recesses.

The vertical leg 82 of lever 80 has a bifurcated lower end at which it carries a cross pin 85. A coil spring 86 is under tension between cross pin 85 and a fixedly mounted cross pin 87 at the opposite end of the spring. Cross pin 87 is rigidly mounted ia housing wall W-1 (FIG. 9). Spring 86 pulls the right-angled lever 80 counter-clockwise in FIG. 11 and thereby pulls down on the tensioning roller 53.

The angular position of tensioning roller 53 is adjustable by an adjusting screw member 88, which has a screw-threaded stem 89 extending slidably through a cross bore 90 (FIG. 9) in a fixedly mounted horizontal shaft 91, which presents a flattened vertical face 92 on its side toward the right-angled lever 80 and a flattened vertical face 93 on its opposite side. Shaft 91 is fixedly mounted in housing wall W-1. The vertical leg 82 of lever 80 is bifurcated at its upper end, presenting opposite segments 82*a* and 82*b*. The adjusting screw member 88 has an enlarged rectangular head segment 94 which is snugly received between the opposite segments 82*a* and 82*b* of the bifurcated upper end of vertical leg 82. A cross pin 96 pivotally connects segment 94 of the adjusting screw to the right-angled lever 80 at this corner of the lever. A nut 97 threadedly engages the stem 89 of the adjusting screw next to the flattened face 93 of fixed shaft 91.

Figure 10:
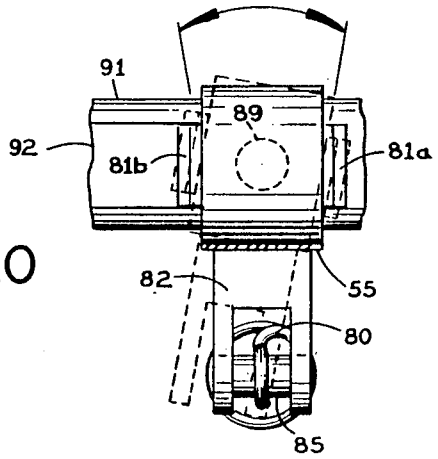
FIG. 10 is an end elevation taken from the line 10—10 in FIG. 9 and showing part of the belt tensioning and positioning mechanism.

The tensioning roller 53 can be adjusted angularly about the axis of the adjusting screw 88 by loosening the nut 97 and turning the adjusting screw in one direction or the other and then re tightening the nut. The lever 80 turns in unison with the adjusting screw 88 and the roller 53 moves with lever 80. For example, as shown in FIG. 10, the tensioning roller 53 can be adjusted from the position shown in full lines to the position shown in phantom if this is necessary for proper alignment between tensioning roller 53 and sanding belt 55.

The tensioning roller 54 for sanding belt 56 has an identical arrangement enabling it to be adjusted in the manner just described for roller 53. This adjustment arrangement is partially shown in FIG. 9.

Referring to FIGS. 1 and 11, on the exit side of the first abrading station 15 an upper drive shaft 98 supports a laterally spaced pair of smooth surfaced, cylindrical rollers 99 and 100 of rubber or rubber like material (FIG. 2), which are identical to and longitudinally aligned with the belt-deflection rollers 23 and 24, respectively, in the first abrading station 15. Shaft 98 also carries knurled film advance rollers 101, 102 and 103 which correspond to the film-advance rollers 25, 26 and 27 in the first abrading station. Shaft 98 carries the previously mentioned gear 77 and is driven from motor 28 through the belt-and-pulley drive and the gear drive already described.

Directly below these drive rollers are spring-loaded pressure rollers 104 like the pressure rollers 30, 30*a*, 31, 31*a*, 32 and 32*a* (FIG. 6) ia the first abrading station.

As shown in FIG. 11, the Mylar sheet after coming out of the first abrading station 15 passes between the upper rollers 99 and 100 on shaft 98 and the pressure rollers 104 below.

The second abrading station 16 is substantially identical to the first abrading station 15 except that it has three instead of two sets of belt-deflection rollers and sanding belts and these are offset laterally from those in the first abrading station so as to remove the three remaining tracks 19, 20 and 21 of photographic images (FIG. 13) which remain on the Mylar sheet S after it has passed through the first abrading station.

Elements in the second abrading station which correspond to those in the first are given the same reference numerals plus 100 as the elements in the first abrading station with the exception that the third set of elements has a "prime" suffix added to each. For example, in the second abrading station the belt deflection rollers are designated by reference numerals 123, 124 and 124' (FIG. 2).

The mode of operation in the second abrading station 16 is identical to what happens in the first abrading station 1 except for the location of the tracks of photographic images on the Mylar sheet that are removed. Therefore, a complete detailed description of the elements in the second abrading station and the mode of operation there is considered unnecessary.

As shown in FIGS. 2 and 7, in the second abrading station of the apparatus a horizontal shaft 122 is attached to gear 75. Shaft 122 rotatably supports three belt-deflection rollers 123, 124 and 124' by means of ball bearings and two knurled film-advance rollers 126 and 127 are affixed to shaft 122 to rotate in unison with it. Roller 126 is between rollers 123 and 124, end roller 127 is between rollers 124 and 124'. Paired pressure rollers 130 and 130*a*, and 131 and 131*a*, are resiliently supported below the film-advance rollers 126 end 127 by spring-biased plungers 135 and 137. Three flexible endless sanding belts 155, 156 and 156' respectively pass beneath rollers 123, 124 and 124'. Belt 155 does not engage the adjacent pressure roller 130. Belt 156 does not engage the adjacent pressure rollers 130*a* and 131. Belt 156' does not engage the adjacent pressure roller 131*a*. The Mylar sheet S passes over the upper run of abrasive belts 155, 156 and 156' and is engaged from above by rollers 123, 126, 124, 127 and 124'. The knurled film-advance rollers 126 and 127, rotating in unison with shaft 122, advance the Mylar sheet through the second abrading station in the same manner that the knurled rollers 25, 26 and 27 in the first abrading station move it through that station.

With this arrangement superior results are achieved because of the "partial wrap-around" path each sanding belt takes under the corresponding belt-deflection roller 23, 24, 123, 124 or 124'. The linear speed of the sanding belt is several times that of the Mylar sheet S, as determined by the surface speed of the knurled film-advance rollers (25, 26 and 27 in the first abrading station; 126 and 127 in the second abrading station). Therefore, the sanding belts have an extremely effective scraping action such that no significant trace of photographic image remains on the corresponding longitudinal tracks on the Mylar sheet S. The Mylar sheet is completely scraped free of photographic images after it has gone through the first and second abrading stations 15 and 16 just once.

From the foregoing description and the accompanying drawings it will be evident that, in accordance with this invention, the area of the film member that is being scraped at any given instant also is being clamped between the film-advance rollers ana the corresponding pressure rollers. This simultaneous clamping and scraping contributes to the effectiveness and thoroughness with which the photographic images are removed from the film member.

I claim:

1. A photographic image removal apparatus for use with a flexible film member having photographic images on one face thereof, said apparatus comprising:

an endless flexible belt having an abrasive face and an opposite face;

belt drive means for moving said belt repeatedly along an endless path at a predetermined speed;

belt deflection means having a curved periphery in confronting relationship to said abrasive face of the belt and positioned to deflect said belt to follow the contour of said curved periphery for part of its extent;

means for tensioning said belt to thereby cause said belt to follow the contour of said curved periphery of said belt-deflection means for said part of its extent;

movable film-advance means next to said belt-deflection means, said film advance means having a periphery for engaging the film member beyond said belt;

drive means for moving said periphery of said film-advance means at e speed many times less than said predetermined speed of said belt;

and pressure means positioned in confronting relationship to said periphery of said film-advance means to engage the film member between them and cause said film member to move between said belt-deflection means and said belt substantially at the speed of said periphery of said film-advance means.

2. An apparatus according to claim 1 wherein:

said film-advance means moves said film member in the same general direction as the movement of said belt past said belt-deflection means.

3. An apparatus according to claim 1 and further comprising:

yieldable means biasing said pressure means toward said film-advance means to drivingly engage said film member between them.

4. An apparatus according to claim 1 wherein:

said belt-deflection means and said film-advance means are coaxial rollers of substantially the same diameter.

5. A photographic image removal apparatus for use with a flexible photographic film member having photographic images on one face thereof, said apparatus comprising:

an endless flexible belt having an abrasive face and an opposite face;

belt drive means for moving said belt repeatedly along an endless path at a predetermined speed;

belt-deflection roller means positioned along said path in confronting relationship to said abrasive face of the belt to deflect said belt to follow the peripheral contour of said belt-deflection roller means over a predetermined circumferential portion thereof;

film-advance roller means next to said belt-deflection roller means ana beyond said belt, said film-advance roller means being coaxial with and substantially the same diameter as said belt-deflection roller means;

drive means for rotating said film advance roller means at a peripheral surface speed thereof many times less than said predetermined speed of said belt;

and pressure roller means positioned in confronting relationship to said film advance roller means to engage the film member between them and force said film member between said belt deflection roller means and said belt at substantially said peripheral surface speed of said film-advance roller means.

6. An apparatus according to claim 5 and further comprising means for tensioning said belt to hold said belt contiguous to said predetermined circumferential portion of said belt-deflection roller means.

7. An apparatus according to claim 6 and further comprising:

spring means biasing said pressure roller means against said film-advance roller means.

8. An apparatus according to claim 7 wherein:

said film advance roller means moves said film member in the direction of travel of said belt past said belt-deflection roller means.

9. An apparatus according to claim 7 wherein:

said belt-deflection roller means end said film-advance roller means are above said abrasive face of the belt;

and said pressure roller means is below and substantially aligned vertically with said film-advance roller means.

10. An apparatus according to claim 7 wherein:

said belt drive means includes drive roller means located after said belt-deflection roller means along said path of said belt and engaging said opposite face of said belt from below, said drive roller means having the top of its periphery at a higher level than the bottom of the periphery of said belt-deflection roller means;

and further comprising:

idler roller means located ahead of said belt-deflection roller means along said path of said belt and engaging said opposite face of said belt from below, said idler roller means having the top of its periphery at a higher level than the bottom of the periphery of said belt deflection roller means.

11. An apparatus according to claim 10 and further comprising:

spring means holding said pressure roller means up against said film advance roller means.

12. An apparatus according to claim 10 end further comprising:

a tension roller spaced below said pressure roller means and engaging said opposite face of said belt from above;

and means urging said tension roller downward to tension said belt and hold said belt up contiguous to the bottom of said belt-deflection roller means.

13. An apparatus for removing photographic images from one face of a flexible Mylar film member comprising:

a first abrading station having:

a first set of laterally spaced belts, each having an abrasive outer face, an opposite inner face and opposite longitudinal edges;

belt drive means for moving said belts repeatedly along respective laterally spaced endless paths at a predetermined speed;

a first set of coaxial belt deflection rollers positioned respectively along said paths above said abrasive faces of the respective belts to deflect the corresponding belt downward to follow the peripheral contour of the respective belt-deflection roller over a predetermined circumferential bottom portion thereof;

a first set of film advance rollers coaxial with said belt-deflection rollers beyond said longitudinal edges of the respective belts, said film advance rollers being substantially the same diameter as said belt deflection rollers;

drive means for rotating said film advance rollers at a peripheral surface speed many times less than said predetermined speed of said belts;

and a first set of pressure rollers positioned immediately below said film advance rollers for engaging said film member between them to advance said film member between said belt-deflection rollers and said belts at substantially said peripheral surface speed of said film-advance rollers.

and a second abrading station having:

a second set of laterally spaced belts offset laterally from the belts of said first set and each having an abrasive outer face, an opposite inner face, and opposite longitudinal edges;

belt drive means for moving said second set of belts repeatedly along respective laterally spaced endless paths at said predetermined speed of said first set of belts;

a second set of coaxial belt deflection rollers positioned respectively along said paths above said abrasive faces of said second set of belts to deflect the corresponding belt downward to follow the peripheral contour of the respective deflection roller over a predetermined circumferential bottom portion thereof;

a second set of film-advance rollers coaxial with said second set of belt-deflection rollers beyond said longitudinal edges of the respective belts, said second set of film advance rollers being substantially the same diameter as said second set of belt deflection rollers;

drive means for rotating said second set of film-advance rollers at a peripheral surface speed many times less than said predetermined speed of said second set of belts;

and a second set of pressure rollers positioned immediately below said second set of film-advance rollers for engaging said film member between them to advance said film member between said second set of belt deflection rollers and said second set of belts at substantially said peripheral surface speed of said second set of film-advance rollers.

14. An apparatus according to claim 13 and further comprising means in each of said abrading stations for tensioning said belts therein to hold said belts up against said circumferential bottom portion of the respective belt-deflection rollers.

15. An apparatus according to claim 14 wherein:

said first set of film advance rollers advances said film member in the same general direction as the movement of said first sets of belts past said first set of belt-deflection rollers;

and said second set of film-advance rollers advances said film member in the same general direction as the movement of said second set of belts past said second set of belt-deflection rollers.

16. An apparatus according to claim 15 wherein said belt drive means in each of said abrading stations comprises a set of drive rollers located after said belt-deflection rollers along said paths of the corresponding belts and engaging the respective inner faces of said belts from below, each of said drive rollers having the top of its periphery at a higher level than the bottom of the periphery of the corresponding belt-deflection roller;

and each of said abrading stations further comprises:

a set of idler rollers located ahead of said belt-deflection rollers along said paths of said belts in said abrading station and engaging the respective inner faces of said belts from below, each of said idler rollers having the top of its periphery at a higher level than the bottom of the periphery of the corresponding belt-deflection roller.

17. An apparatus according to claim 16 wherein each of said abrading stations further comprises:

a set of tension rollers located below said pressure rollers and respectively engaging the inner faces of said belts from above;

and spring means acting on said tension rollers to pull down on said belts and thereby hold said belts up against the bottom of the periphery of the corresponding belt-deflection rollers.

18. An apparatus according to claim 17 wherein each of said abrading stations further comprises respective springs biasing said pressure rollers upward.

19. An apparatus according to claim 13 wherein each of said abrading stations further comprises respective springs biasing said pressure rollers upward.

20. A method of removing photographic images from a flexible film member having opposite major faces which comprises the steps of:

advancing said film member through an abrading station;

and in said abrading station momentarily clamping a predetermined short length of said film member across part of its width while abrading said short length of the film member across a neighboring different part of its width to scrape photographic images therefrom.

21. A method according to claim 20 wherein:

said clamping step is performed by engaging said opposite major faces of said film member between opposed rollers which advance said film member through said abrading station at a predetermined speed;

said abrading step is performed by an endless flexible abrasive belt scraping one of said major faces of said film member and moving through said abrading station at a much higher speed than said predetermined speed;

and further comprising the step of deflecting said film member and said abrasive belt to follow the peripheral contour of one of said rollers for part of its circumferential extent for scraping contact of said abrasive belt with said one major face of said film member throughout said part of said circumferential extent of said roller.

22. A method according to claim 21 wherein:

said film member is advanced through said abrading station in the same general direction as the movement of said belt through said abrading station.

23. A method of removing photographic images from a flexible film member having opposite major faces which comprises the steps of:

advancing said film member through a first abrading station;

in said first abrading station momentarily clamping successive short lengths of said film member across a plurality of laterally separated parts of its width while abrading said successive short lengths of the film member across different parts of its width next to said laterally separated parts;

advancing said film member from said first abrading station through a second abrading station;

and in said second abrading station momentarily clamping said successive short lengths of said film member across said different parts of its width while abrading said successive short lengths of the film member across said laterally separated parts.

* * * * *